US007292136B2

(12) United States Patent
Zimmermann

(10) Patent No.: US 7,292,136 B2
(45) Date of Patent: Nov. 6, 2007

(54) AUDIBLE SIGNAL DEVICE AND MACHINES USING SAME

(75) Inventor: Daniel E. Zimmermann, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 192 days.

(21) Appl. No.: 11/030,629

(22) Filed: Jan. 6, 2005

(65) Prior Publication Data

US 2006/0158318 A1 Jul. 20, 2006

(51) Int. Cl.
*G08B 3/10* (2006.01)

(52) U.S. Cl. ..... 340/384.7; 340/384.73; 340/438; 340/439; 340/679

(58) Field of Classification Search ..... 340/384.7, 340/384.73, 388.1, 679, 685, 684, 692, 438, 340/439, 449, 450, 450.1, 450.2, 450.3, 451–456
See application file for complete search history.

(56) References Cited

U.S. PATENT DOCUMENTS 3,992,585 A 11/1976 Turner et al.
4,684,870 A 8/1987 George et al.
4,903,696 A * 2/1990 Stasz et al. ..... 606/37
5,321,756 A 6/1994 Patterson, Jr. et al.
5,406,254 A 4/1995 Le Nay et al.
5,793,184 A 8/1998 O'Connor
5,886,638 A 3/1999 Tanguay
5,896,091 A 4/1999 Soderlund
5,966,078 A 10/1999 Tanguay
5,966,079 A 10/1999 Tanguay
5,969,600 A 10/1999 Tanguay
6,307,482 B1 * 10/2001 Le Bel ..... 340/691.8
6,400,821 B1 * 6/2002 Burgan et al. ..... 379/361
6,445,790 B1 * 9/2002 Burgan et al. ..... 379/361

* cited by examiner

*Primary Examiner*—Toan N. Pham
(74) *Attorney, Agent, or Firm*—Liell & McNeil

(57) ABSTRACT

An audible signal device which includes a DC to DC converter is provided. A group of work machines is further provided, including at least two work machines having electrical systems with different operating voltages. First and second audible signal devices are coupled with the first and second electrical systems respectively, wherein the second audible signal device is interchangeable with the first audible signal device and at least one of the devices includes a DC to DC converter. A method of assembling a plurality of dissimilar machines, each including an interchangeable audible signal device is further provided.

13 Claims, 2 Drawing Sheets

AUDIBLE SIGNAL DEVICE AND MACHINES USING SAME

TECHNICAL FIELD

The present disclosure relates generally to audible signal devices and machines using the same, and relates more particularly to a group of machines having electrical systems with different operating voltages but interchangeable audible signal devices, and a method of assembly therefor.

BACKGROUND

Audible signal devices are used across a broad range of mechanical and electromechanical devices. A typical audible signal device consists of a selectively activated speaker or other sound-generating device coupled with an electrical power system. Familiar examples of audible signal devices include any of the various beepers, buzzers and bells activated in a work machine when a particular operating condition is detected. For instance, in many work machines a bell is activated within earshot of an operator to alert him or her to a particular engine condition, such as low oil or elevated engine temperature.

Work machine audible signal devices have evolved significantly over many decades of technological development. With the advent of electronic control over many aspects of work machine operation, audible signal devices are now often operably coupled with an electronic control module of the work machine. One or more sensors are provided, also coupled with the electronic control module, for monitoring various aspects of operation, such as engine temperature, oil pressure, fuel pressure and level, and even tire pressure. When out-of-specification conditions are detected by the electronic control module from any of the sensors, the electronic control module may activate the audible signal device to alert the operator, allowing him or her time to shut down or adjust the work machine prior to the occurrence of any damage or other undesirable condition.

Several audible signal device designs are known in the art. The oldest of these are conventional "buzzers," also known in the art as electromechanical and electromechanical-based audible signal devices. These devices generally include an electromagnet that actuates an armature plate to strike a diaphragm. The output frequency of such devices is generally in an acceptable audio range, around 500 Hz, and is therefore not overly directional, nor too high for some operators to hear, as may be the case with higher frequency devices.

Nevertheless, component wear and environmental degradation over time are problems inherent in any design having moving parts that strike one another. Where electrical contacts directly connect with the movable armature, as in an electromechanical-based design, the contacts will also wear over time, and may be susceptible to moisture-related corrosion. Moreover, overheating during continuous operation is a known problem with existing electromechanical-based designs, as is excessive radio frequency output, which can interfere with the work machine electronics and reduce operating efficiency.

In more recent years, piezoelectric based designs have become commonplace. A piezoelectric based design typically utilizes a ceramic plate having piezoelectric crystals therein that change conformation as a voltage across the same is adjusted. As a result, the crystals can induce a vibration, and hence sound, in a diaphragm as they rapidly change conformation in an oscillating electric field. While such devices have been successful in certain applications, they are characterized by a relatively high frequency sound output, about 2100 Hz and above, which may be difficult to hear for some operators having reduced hearing sensitivity to higher frequencies. Further, the high frequency sound can create regions of varying loudness as it reflects off surfaces in the work machine operator cab. Because work machines often operate in relatively loud work environments, such as construction zones, mines, and lumber mills, it can be challenging for operators to detect an audible signal quickly and positively, such that they are able to shut down or adjust the machine operation without undue delay.

In spite of a number of shortcomings, the above audible signal device designs have each proven useful in various applications over the years. However, where one design may be well suited to a first type of work machine, it may be less well suited to a second type where the work machines have electrical systems with differing operating voltages. For example, a relatively small track-type tractor will typically have a different operating voltage for its electrical system than a relatively large work machine such as a motor grader. Despite this, both work machines require various monitoring devices and signal means, such as audible signal devices, which need not necessarily be significantly different in design. In the past, engineers typically developed a particular audible signal device suitable for use in a particular line of work machines, rather than utilizing audible signal devices applicable commonly to dissimilar work machines.

The present disclosure is directed to one or more of the problems or shortcomings set forth above.

SUMMARY OF THE DISCLOSURE

In one aspect, the present disclosure provides an audible signal device. The audible signal device includes a speaker, an electronic oscillator current coupled with the speaker, and a DC to DC converter coupled with the speaker and with the electronic oscillator.

In another aspect, the present disclosure provides a group of machines, including at least two machines. A first electrical system is disposed in one of the at least two machines, and has a first operating voltage. A second electrical system is disposed in another of the at least two work machines, and has a second operating voltage different from the first operating voltage. A first audible signal device is operably coupled with the first electrical system, whereas a second audible signal device is operably coupled with the second electrical system. The second audible signal device is interchangeable with the first audible signal device. At least one of the first and second audible signal devices includes a DC to DC converter coupling the respective audible signal device with the respective electrical system.

In still another aspect, the present disclosure provides a method of assembling a plurality of dissimilar machines. The method includes the step of connecting one of a plurality of interchangeable audible signal devices with an electrical system of a first machine selected from among a plurality of dissimilar machines, the first machine having a first operating voltage. The method further includes the step of connecting another of the plurality of interchangeable audible signal devices with an electrical system of a second machine selected from among the plurality of dissimilar machines, the second machine having a second operating voltage different from the first operating voltage.

DETAILED DESCRIPTION

Figure 1:
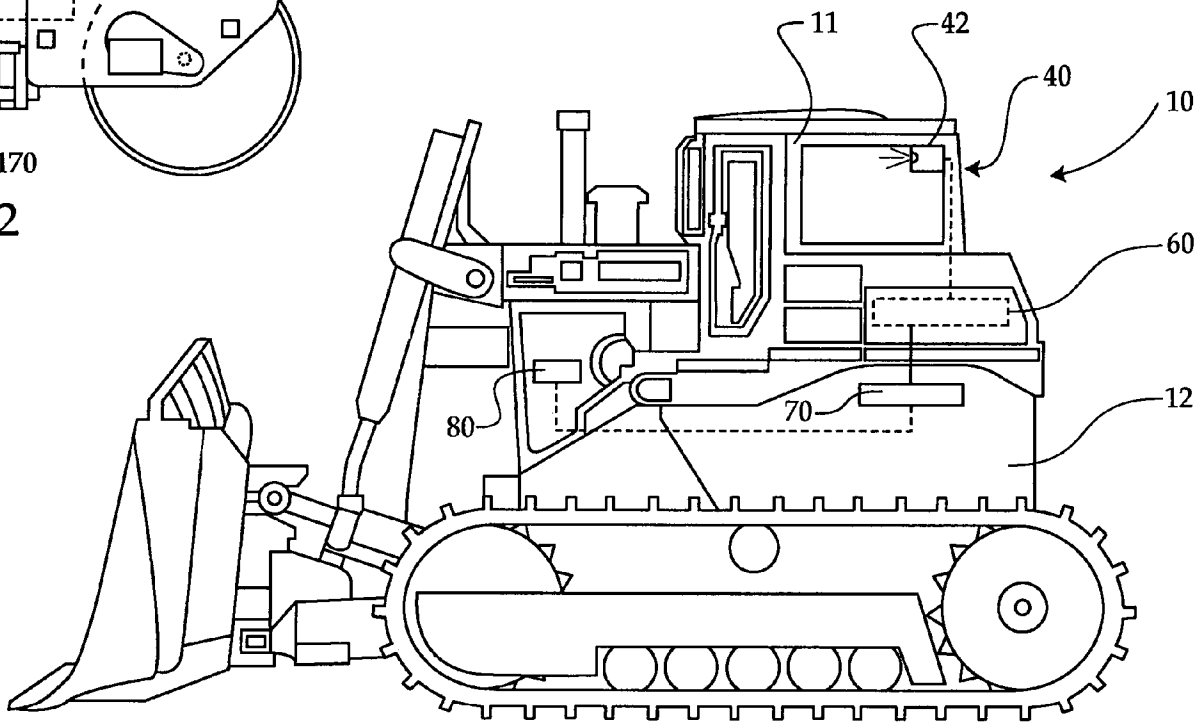
FIG. 1 is a diagrammatic side view of a work machine according to the present disclosure.

Referring to FIG. 1, there is shown a work machine 10 according to the present disclosure. Work machine 10 includes a work machine body 12, having an audible signal device 40 disposed therein. An electrical system 60 is further disposed within work machine 12, and powers audible signal device 40 such that an audible signal or alarm is generated at a speaker 42, for example, mounted within an operator cab 11. An electronic control module 70 may further be provided and is operable to selectively activate audible signal device 40, as described herein. Electronic control module 70 will typically be connected with electrical system 60 and one or more sensors 80, for example, an engine oil pressure sensor.

Figure 2:
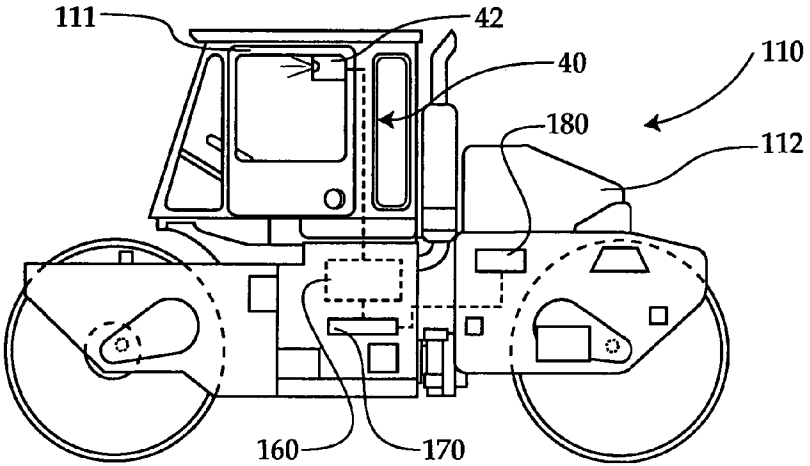
FIG. 2 is a side diagrammatic view of a work machine according to the present disclosure dissimilar to the work machine of FIG. 1.

Referring also to FIG. 2, there is shown a second and dissimilar work machine 110 including an operator cab 111 on a work machine body 112. Work machine 110 also includes an electrical system 160 which powers an audible signal device 40 mounted within operator cab 111. An electronic control module 170 may be provided, and is operable to selectively activate audible signal device 40. One or more sensors 180, for example, an engine oil pressure sensor or another type of sensor may be provided, as in work machine 10. Like numerals are used to identify each audible signal device 40 and speaker 42 in the respective work machines, as each of work machines 10 and 110 may include similar or identical audible signal devices 40 therein.

Work machine 10 is illustrated as a track-type tractor, whereas work machine 110 is shown as a compactor. It should be appreciated, however, that the illustrated designs are exemplary only, and a wide variety of machines are contemplated as falling within the scope of the present disclosure. Work machines 10 and 110 together comprise a group of at least two work machines. The respective electrical systems, 60 and 160 may have different operating voltages, and in one embodiment at least one of electrical systems 60 and 160 has an operating voltage different from an operating voltage of the respective audible signal device 40, which may be, for example, 5V. Thus, work machines 10 and 110 are dissimilar in that the respective electrical systems 60 and 160 will typically have different operating voltages. Despite the different operating voltages, audible signal devices 40 will typically be interchangeable among the at least two work machines 10 and 110, as described herein.

Figure 3:
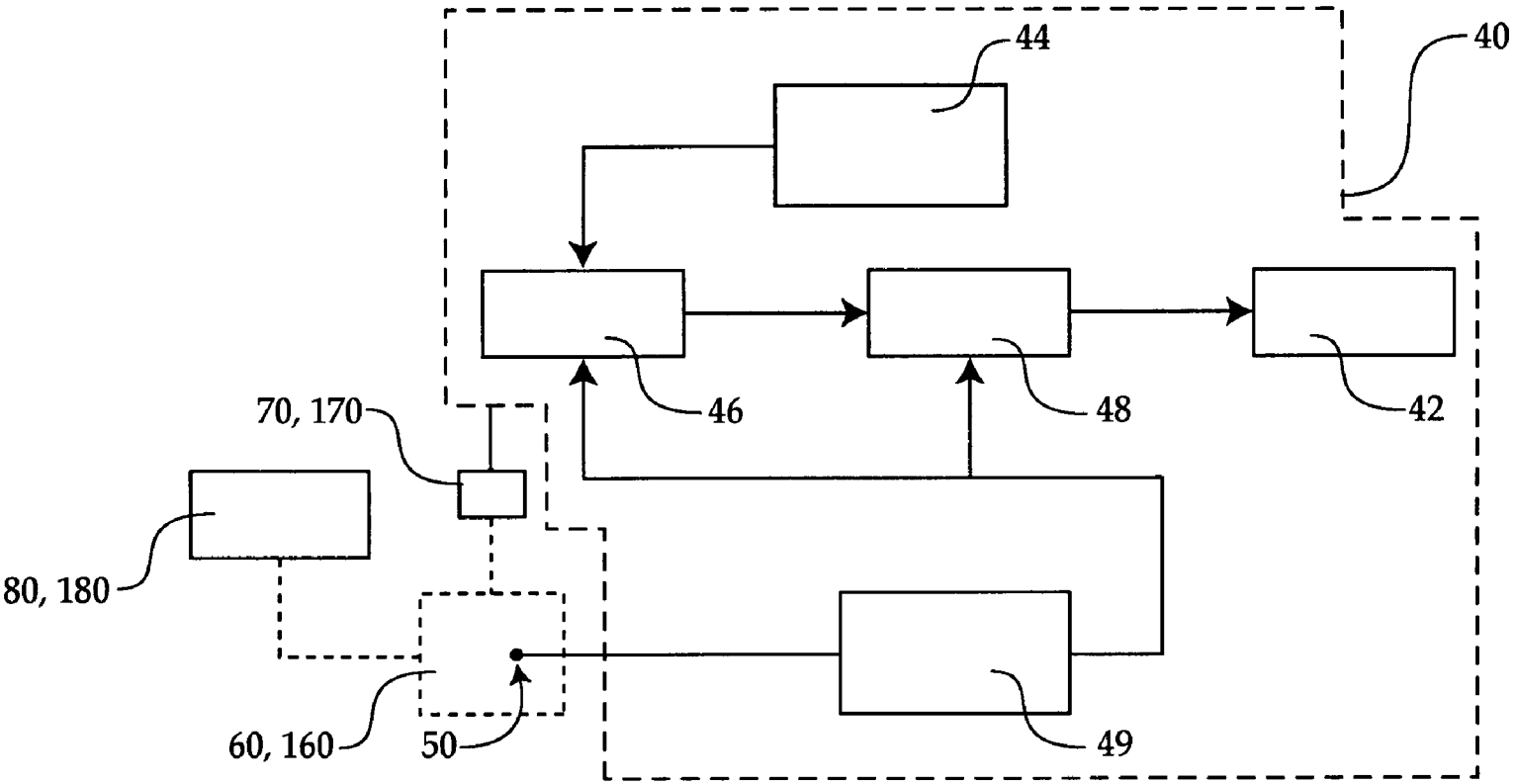
FIG. 3 is a schematic view of a portion of a work machine including an audible signal device according to the present disclosure.

Turning also to FIG. 3, there is shown a schematic illustration including an audible signal device 40 suitable for use with either of work machines 10 and 110. Audible signal device 40 will include a speaker 42, which may be a bi-directional speaker, and will typically be a voice coil speaker. Other speaker types are contemplated, however, including piezoelectric and electromechanical speakers. Voice coil speakers generally consist of a movable diaphragm or speaker cone driven at a selected frequency by an oscillating current in a coil that is placed in a magnetic field produced by a permanent magnet. Plastic will typically be a practical material for constructing the diaphragm, as it is relatively durable and resistant to moisture degradation. The diaphragm may be driven back and forth in opposite directions by the magnetic field and, accordingly, it is unnecessary to return the diaphragm to a rest position with a biasing spring, as in certain electromechanical designs.

An electronic oscillator 46, which may be any suitable electronic oscillator known in the art, may be provided in audible signal device 40 and is operable to provide an oscillating electrical output for driving speaker 42, typically via a power amplifier 48, which may be a conventional audio amplifier. The frequency of the oscillating magnetic field produced at speaker 42 may be adjustable to provide a desired output frequency of the sound produced by the moving diaphragm. Typically, the output frequency will be selected to provide a signal that corresponds to a resonance frequency of the diaphragm itself. To this end, a digital potentiometer 44 may be provided, allowing a technician or, for example, electronic control module 70, 170 to set or adjust a frequency of electronic oscillator 46.

It is contemplated that audible signal device 40 will in many instances be utilized in a work machine 10, 110 equipped with an electronic control module 70, 170, shown in FIG. 3 as connected with electrical system 60, 160. The sensor 80, 180 is further shown in communication with electrical system 60, 160, and in turn operably coupled with electronic control module 70, 170. It should be appreciated, however, that designs are contemplated wherein the sensor 80, 180 is directly coupled with audible signal device 40 and activates the same upon sensing a predetermined condition in work machine 10, 110 rather than via electronic control module 70.

Audible signal device 40 may be electrically connected with the respective work machine electrical system 60, 160 via a DC input 50. A DC to DC converter 49, many of which are well known in the art, couples audible signal device 40 with electrical system 60, 160. DC to DC converter 49 will typically be operable to provide a constant operating voltage to audible signal device 40, and will be a separate component from electronic oscillator 46. In other words, DC to DC converter 49 may be operable to simultaneously provide power from DC input 50 to both speaker 42 and electronic oscillator 46, at a selected operating voltage. The constant operating voltage may be provided to audible signal device 40 across a range of input voltages from DC input 50, for example, typically anywhere from 9V to 32V DC from electrical system 60, 160. The particular input voltage to DC to DC converter 49 will depend upon the operating voltages of the respective electrical systems of the group of work machines 10, 110. In one contemplated embodiment, DC to DC converter 49 will be current coupled with speaker 42, for example via power amplifier 48, and also current coupled with electronic oscillator 46. In other words, the respective connections between DC to DC converter 49 and the other components of audible signal device 40 will typically be such that an actual DC current flow takes place between the components. Similarly, electronic oscillator may be current coupled, via power amplifier 48, with speaker 42.

Returning to FIGS. 1 and 2, at least one of work machines 10, 110 will typically include a DC to DC converter 49 connecting its respective audible signal device 40 with its electrical system 60, 160. In some instances, one of the group of work machines 10, 110 may have an electrical system with an operating voltage that is close or equal to the operating voltage of the selected audible signal device 40. In such a case, it may not be necessary to utilize DC to DC converter 49. In other instances, some means other than a DC to DC converter might be used providing the desired operating voltage to the respective audible signal device 40, such as a conventional voltage divider (not shown). In a typical case, however, a single audible signal device design, such as is shown in FIG. 3, will be provided for the entire group of work machines.

In part by facilitating the use of interchangeable parts, the present disclosure further provides a method of assembling a plurality of different machines, for example, work machines 10 and 110. The method includes the step of connecting one of a plurality of interchangeable audible signal devices 40 with an electrical system 60 of a first machine 10 selected from among a plurality of dissimilar machines 10, 110, the first machine 10 having a first operating voltage. The method further includes the step of connecting another of the plurality of interchangeable audible signal devices 40 with an electrical system 160 of a second machine 110 selected from among the plurality of dissimilar machines 10, 110, the second machine 110 having a second operating voltage different from the first operating voltage. Each of the audible signal devices 40 may be identical, and connected with the respective electrical system 60, 160 via DC to DC converter 49. During or following assembly, digital potentiometer 44 may be set or adjusted to provide a desired output frequency from electronic oscillator 46, to vary the output audio for specific applications.

INDUSTRIAL APPLICABILITY

Referring to the drawing Figures generally, during operation of work machine 10, 110, any of a variety of selected operating conditions may trigger activation of the respective audible signal device 40. When such a condition develops, it may be detected by sensor 80, 180, and a signal sent to electronic control module 70, 170, for example. Electronic control module 70, 170 may then activate audible signal device 40 to provide an audible signal to an operator via speaker 42, as described herein. DC to DC converter 49 will be operable to provide the selected operating voltage to audible signal device 40, regardless of a difference in operating voltage between electrical system 60, 160 and audible signal device 40.

A wide variety of potential operating conditions and appropriate sensors can be selected to thus trigger activation of audible signal device 40, including but not limited to oil pressure, fuel pressure, fuel level, engine or transmission temperatures and the like, or even engine RPM. Similarly, audible signal device 40 may be triggered where work machine 10, 110 encounters a work surface that is too steep or too soft, or an obstruction is detected on the work surface, for example.

By facilitating powering of audible signal device 40 with a range of input voltages, DC to DC converter 49 allows audible signal (device 40 to be utilized in dissimilar work machines 10, 110 having different operating voltages in each respective electrical system 60, 160. While two different work machines 10 and 110 are shown, those skilled in the art will appreciate that an even greater number of dissimilar work machines, having more than two different electrical system operating voltages might be equipped with an audible signal device 40 according to the present disclosure. Accordingly, a single audible signal device design can be utilized in an entire fleet of work machines, reducing the number of necessary parts, number of different designs, and simplifying the overall ease of manufacturing.

The present disclosure thus provides a design for an audible signal device 40 that facilitates assembly of plural work machines 10, 110, having different operating voltages, but similar or identical audible signal devices 40. Rather than designing and manufacturing separate audible signal devices 40 for each different machine 10, 110, a single, universal part can be constructed that is suitable for use in numerous dissimilar work machines.

The present description is for illustrative purposes only and should not be construed to narrow the breath of the present disclosure in any way. Thus, those skilled in the art will appreciate that various modifications might be made to the presently disclosed embodiments without departing from the spirit and scope of the present disclosure. Further, while each audible signal device 40 used in the group of work machines 10, 110 may be identical, modifications might be made to the particular audible signal device disposed within a particular work machine without departing from the scope of the present disclosure. For example, work machines operating in especially wet environments, or particularly loud environments, might include different speaker technologies than work machines operating in relatively dry or quieter environments, but might otherwise be similar or identical.

Further still, while each of work machines 10, 110 is described herein as having only a single audible signal device 40, those skilled in the art will appreciate that work machines might be equipped with plural audible signal devices 40 according to the present disclosure, each operable to alert the operator to a different operating condition. One type of audible signal device, having a first selected output frequency might be well suited to alerting an operator as to engine problems, whereas another type of audible signal device, having a different selected output frequency might be provided for alerting the operator to outside obstructions. Other design differences, such as speaker type and output frequency, orientation within cab 11, 111, and positioning inside or outside of cab 11, 111 might be employed to provide an operator with a variety of useful signal types.

It is contemplated that each audible signal device 40 will typically be activated for continuous periods, providing a constant tone. However, electronic control module 70, 170 might be programmed to alert an operator to different types of conditions, or condition severity by selectively activating audible signal device 40 as a constant tone for a first condition type, or only intermittently for a second condition type. Other aspects, features and advantages will be apparent upon an examination of the attached drawing Figures and appended claims.

What is claimed is:

1. An audible signal device comprising:

a speaker;

an electronic oscillator current coupled with said speaker;

a DC to DC converter separate from said electronic oscillator and coupled with said speaker and with said electronic oscillator; and means, including a DC input connection, for rendering the audible signal device an interchangeable part among a plurality of machines having different operating voltages.

2. The audible signal device of claim 1 further comprising a power amplifier current coupled with said speaker, said electronic oscillator and said DC to DC converter, said DC to DC converter being current coupled with said electronic oscillator.

3. The audible signal device of claim 2 further comprising a potentiometer coupled with said electronic oscillator and operable to set or adjust an output frequency thereof.

4. The audible signal device of claim 3 wherein said potentiometer is a digital potentiometer, and said speaker is a bi-directional voice coil speaker.

5. An audible signal device comprising:

a speaker;

an electronic oscillator current coupled with said speaker;

a DC to DC converter separate from said electronic oscillator and coupled with said speaker and with said electronic oscillator;

a power amplifier current coupled with said speaker, said electronic oscillator and said DC to DC converter, said DC to DC converter being current coupled with said electronic oscillator;

a potentiometer coupled with said electronic oscillator and operable to set or adjust an output frequency thereof;

wherein said potentiometer is a digital potentiometer, and said speaker is a bi-directional voice coil speaker; and said audible signal device is coupled by said DC to DC converter with a machine electrical system having an operating voltage different from an operating voltage of said audible signal device, said machine electrical system including an electronic control module and at least one sensor operably coupled with said audible signal device.

6. A group of machines comprising:

at least two machines;

a first electrical system disposed in one of said at least two machines and having a first operating voltage;

a second electrical system disposed in another of said at least two machines and having a second operating voltage different from said first operating voltage;

a first audible signal device operably coupled with said first electrical system; and a second audible signal device operably coupled with said second electrical system, said second audible signal device interchangeable with said first audible signal device;

wherein at least one of said first and second audible signal devices includes a DC to DC converter coupling the respective audible signal device with the respective electrical system.

7. The group of machines of claim 6 wherein each of said first and second audible signal devices comprises:

an electronic oscillator;

a speaker operably coupled with said electronic oscillator; and a digital potentiometer coupled with said electronic oscillator and operable to set or adjust a frequency thereof.

8. The group of machines of claim 7 wherein each of said first and second audible signal devices includes a DC to DC converter coupling said first and second audible signal devices with said first and second electrical systems, respectively.

9. The group of machines of claim 8 wherein:

said at least two machines comprises at least two machines each having at least one sensor and an electronic control module in communication therewith; and said first and second audible signal devices comprise first and second identical audible signal devices in communication with the electronic control module of the respective machine and operably coupled with the respective at least one sensor.

10. A method of assembling a plurality of dissimilar machines comprising the steps of:

connecting one of a plurality of interchangeable audible signal devices with an electrical system of a first machine selected from among a plurality of dissimilar machines, the first machine having a first operating voltage; and connecting another of the plurality of interchangeable audible signal devices with an electrical system of a second machine selected from among the plurality of dissimilar machines, the second machine having a second operating voltage different from the first operating voltage.

11. The method of claim 10 wherein each of the connecting steps comprises connecting the respective interchangeable audible signal device with an electrical system of the respective machine via a DC to DC converter.

12. The method of claim 11 wherein each of the connecting steps comprises connecting an audible signal device that includes an electronic oscillator, a voice coil speaker current coupled with the electronic oscillator, and a digital potentiometer operable to set or adjust a frequency of the electronic oscillator.

13. The method of claim 12 wherein each of the connecting steps comprises connecting an identical audible signal device.

* * * * *